US007262375B2

(12) United States Patent
Sakai

(10) Patent No.: US 7,262,375 B2
(45) Date of Patent: Aug. 28, 2007

(54) SWITCH CONTROL DEVICE FOR VEHICLE

(75) Inventor: Naohiro Sakai, Tokyo (JP)

(73) Assignee: Toyo Denso Kabushiki Kaisha, Minato-ku, Tokyo (JP)

( * ) Notice: Subject to any disclaimer, the term of this patent is extended or adjusted under 35 U.S.C. 154(b) by 0 days.

(21) Appl. No.: 11/549,464

(22) Filed: Oct. 13, 2006

(65) Prior Publication Data

US 2007/0095633 A1 May 3, 2007

(30) Foreign Application Priority Data

Oct. 31, 2005 (JP) ..... 2005-344612

(51) Int. Cl.
*H01H 9/00* (2006.01)

(52) U.S. Cl. ..... 200/5 R; 307/10.1

(58) Field of Classification Search ..... 200/5 R, 200/6 A, 17 R, 18; 307/9.1, 10.1; 318/49, 318/53, 449, 292, 293; 345/156, 184
See application file for complete search history.

(56) References Cited

U.S. PATENT DOCUMENTS 6,636,200 B2 * 10/2003 Kataoka et al. ..... 345/161
6,657,316 B1 * 12/2003 Smith et al. ..... 307/10.1
6,833,517 B2 * 12/2004 Sotome et al. ..... 200/5 R
6,903,288 B2 * 6/2005 Varga ..... 200/200
6,961,644 B2 * 11/2005 Mercier et al. ..... 701/36
7,030,324 B2 * 4/2006 Gotoh ..... 200/6 A
7,113,854 B2 * 9/2006 Mansell et al. ..... 701/36
7,119,290 B2 * 10/2006 Kim ..... 200/5 R
7,180,018 B2 * 2/2007 Sekino et al. ..... 200/5 A

FOREIGN PATENT DOCUMENTS

JP 11-96853 4/1999
JP 2004-169529 6/2004

* cited by examiner

*Primary Examiner*—Michael A Friedhofer
(74) *Attorney, Agent, or Firm*—Fulbright & Jaworski, LLP

(57) ABSTRACT

A switch control device for control of drives of power windows and power side mirrors of a vehicle, which has a simple and easy-to-operate switch panel provided with a multifunction switch having a square operating surface to be pushed down as a whole and tilted in any of multiple directions and having four switch contacts disposed one at each of four corners of the operating surface, a window opening/closing switch and a left/right side mirror selecting switch, wherein a control mode of the device is automatically changed to a power window control mode when the multifunction switch is not operated for more than a specified period of time, and it is changed from the power window control mode to a power side-mirror control mode when operating the power side mirror selecting switch.

5 Claims, 3 Drawing Sheets

SWITCH CONTROL DEVICE FOR VEHICLE

BACKGROUND OF THE INVENTION

The present invention relates to a switch control device capable of controlling drives of power windows and side mirrors of a vehicle by operating a plurality of switches on a switch panel.

Reference document, JP 11-96853 (hereinafter referred to as document 1) discloses a conventional switch control device provided with a plurality of switches for operating a power window and a power side mirror of a vehicle, which is formed as a part of a master switch panel disposed on the driver's seat side and comprises a mode selector switch 13 for changing the control mode from "power window" to "power side mirror" and vice versa and a multifunction switch 12 for selecting a window and adjusting a viewing angle of the side mirror as shown in FIG. 3. This device is intended to operate the power window and power side mirror with the reduced number of switches.

The multifunction switch 12 comprises a push button switch portion 121 (individual switch) disposed at the center and a multi-directional switch portion 122 arranged at 8 peripheral positions, which are to operate into 8 directions (front/rear, left/right and four diagonal directions). A switch 14 is used for opening/closing a power window. A switch 16 is used for retarding a mirror and a switch 17 is used for locking/unlocking a door. A switch 18 is used for locking/unlocking a window.

When the control mode selector switch 13 is pressed to select the "power window" mode and the central switch portion 121 is then pushed down, all windows are selected to be operated. When the multi-directional switch portion 122 is pressed to tilt for example frontward, left and right windows of the front seats are selected to be operated. When the switch portion 122 is pressed to tilt in the front right direction, the right window is selected to be operated. The selected window can be opened or closed by operating the window closing/opening switch 14.

When adjusting a power side mirror, the control mode selector switch 13 is pushed for sequentially changing the control mode from the power window control mode to the power side mirror control mode, the selector switch 15 is pressed to select a left or right side mirror and then the multi-directional switch portion 122 is pressed to tilt in a desirable direction for adjusting viewing angle of the selected mirror.

A ventilation switch is separately provided for causing all power windows to be opened to a specified degree for ventilation.

In the conventional switch control device for a vehicle, the multifunction switch 122 comprises two separate selector switch portions, i.e., the center pushbutton switch portion 121 for selecting all power windows and the circumferentially disposed multi-directional switch portion 122 for selecting each of the windows or adjusting the viewing angle of each of the mirrors by pushing the switch portion to tilt in a desirable of 8 directions (front, rear, left, right and four diagonal directions) and which therefore has a complicated construction.

The control mode selector 13 is separately provided, which has to be operated to select a power window control mode or power side mirror control mode before operating a switch for driving a power window or a power side mirror.

This does not only decrease the efficiency of switch control operation of the power windows and power side mirrors but also increase the number of switches on the master switch panel.

In addition, the provision of a separate ventilation switch on the master switch panel further increases the number of switches and complicates the operation of the master switch panel.

SUMMARY OF THE INVENTION

Accordingly, an object of the present invention is to provide a switch control device having a switch panel provided with a multifunction switch having a square operating surface to be pushed down as a whole and tilted toward one of multiple directions to turn ON and OFF one or plural switch contacts disposed one at each of four corners, a window opening/closing switch and a power side mirror selecting switch for selecting one of left and right side mirrors. If the multifunction switch is not operated for more than a specified period of time, then the control mode is automatically turned into "power window" control mode. The control mode is turned from "power window" control mode into "power side mirror" control mode by operating the power side mirror selecting switch.

The switch control device for a vehicle according to the present invention measures the operation period of the multifunction switch maintaining at least three of the four corner contacts as in the turned ON state and, if the measured time exceeds a specified period of time, all power windows are selected to be operated by using the window opening/closing switch.

The switch control device for a vehicle according to the present invention measures the operation period of the multifunction switch maintaining at least three of the four corner contacts as in the turned ON state and, until the measured time is less than a specified period of time, all power windows are selected and automatically opened or closed to a specified degree of opening.

The switch control device for a vehicle according to the present invention can effectively conduct switching the control mode from "power window" control mode to "power side mirror" control mode and vice versa and can automatically open the windows to a specified degree of opening for ventilation with no need of providing any separate switches. Thus, the number of switches on the switch panel is reduced and the efficiency of operating the power windows and side mirrors improved.

PREFERRED EMBODIMENTS OF THE INVENTION

Figure 1:
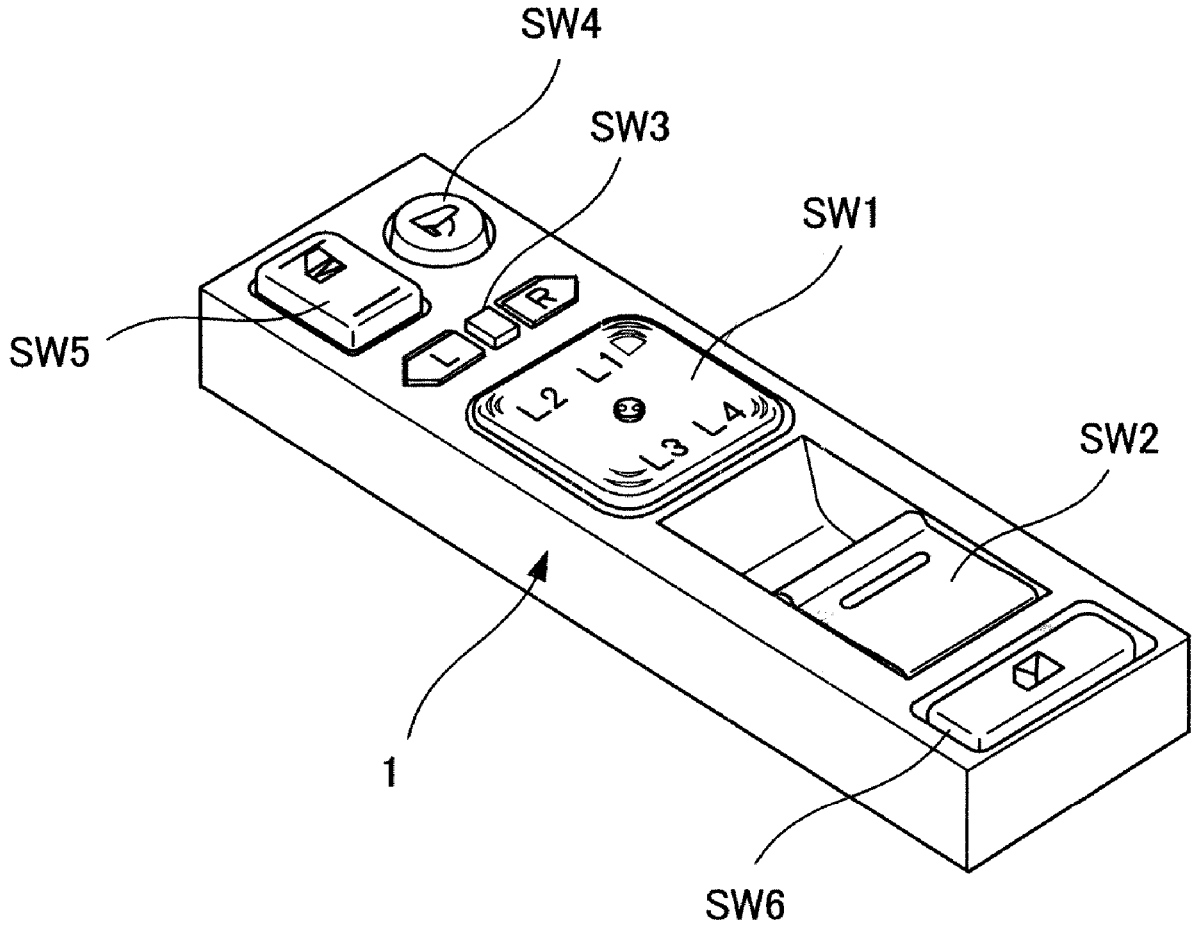
FIG. 1 is a perspective view of an exemplary switch panel of a switch control device for use in a vehicle according to the present invention.

FIG. 1 illustrates a switch panel 1 of a switch control device according to the present invention, which is disposed on the side of the driver's seat in a vehicle. As shown in FIG. 1, the switch control device has a switch panel 1 provided with a reset type multifunction switch SW1 having a square operating surface to be pushed down as a whole and tilted toward one of multiple directions to turn ON and OFF switch contacts disposed one at each of four corners, a window opening/closing switch SW2 and a power side mirror selecting switch SW3 for selecting one of left and right side mirrors. On the switch panel 1, there is further provided a mirror retarding switch SW4, a switch SW5 for locking/unlocking the door and a switch SW6 for locking/unlocking the power window.

The multifunction switch SW1 can be used for changing the control mode from "power window" control mode to "power side mirror" control mode and vice visa in accordance of the state of its operation, selecting all power windows, one of windows on driver's seat side, assistant's seat side, rear left seat side and rear right seat side in the power window control mode and ventilation, and adjusting a viewing angle of the side mirrors in vertical and horizontal directions. The operation of the multifunction switch SW1 will be described later in detail.

The multifunction switch SW1 is provided with pilot lamps L1 to L4 disposed one at each of four corners, which are turned on to indicate the operation states of the switch.

The window opening/closing switch SW2 is of push-pull resetting type, which has two-staged switch functions in each of the push direction and the pull direction.

The first stage of weak push or pull operation of this switch may open or close the selected power window(s) while the switch is kept in that stage. When the second stage of strong (full) push or pull operation of the switch was performed, the power window on the driver's seat side is full opened or closed by the action of the automatic window opening/closing function.

Figure 2:
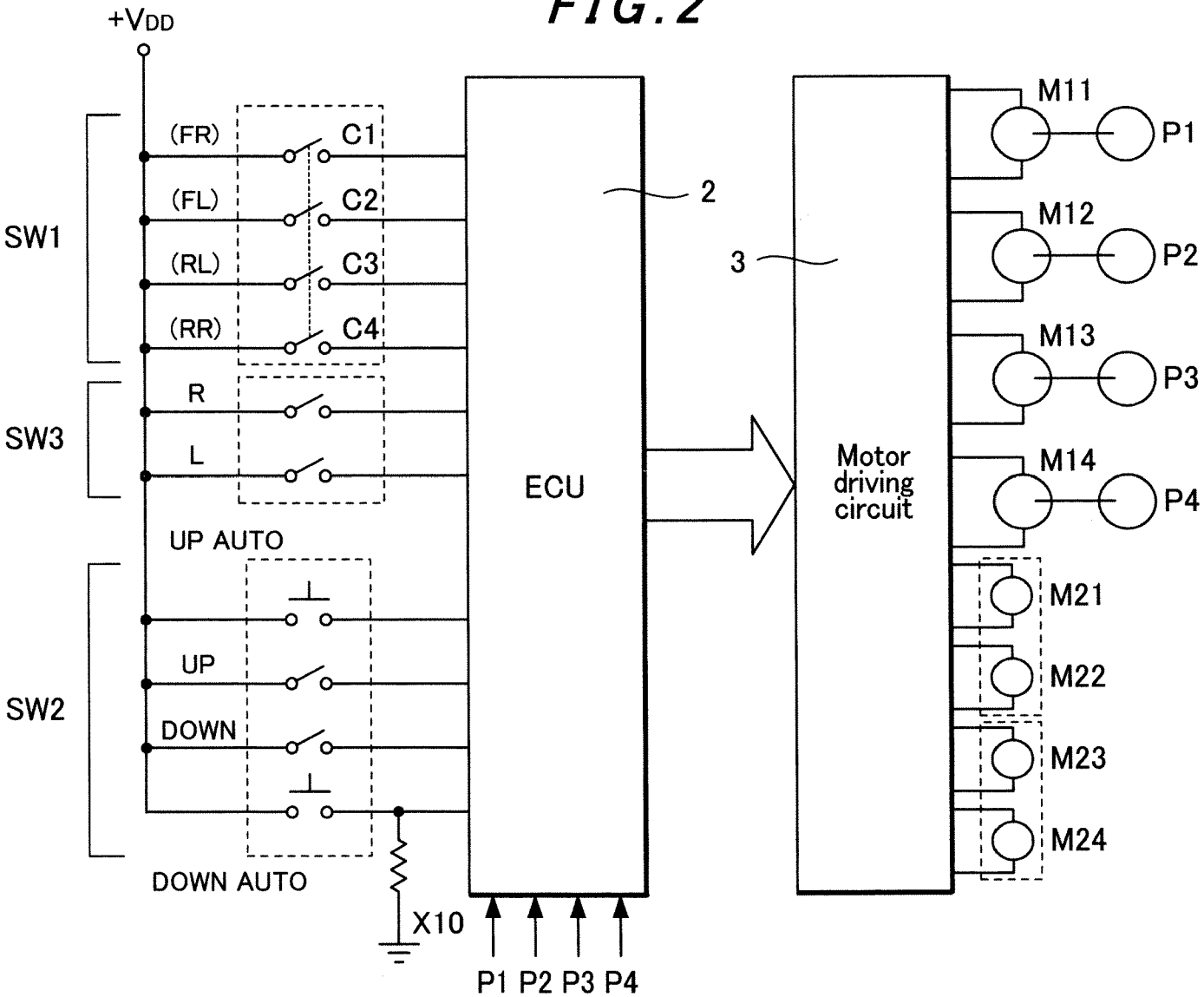
FIG. 2 is an electric circuit diagram illustrating an exemplary control system of a switch control device for use in a vehicle according to the present invention.
Figure 3:
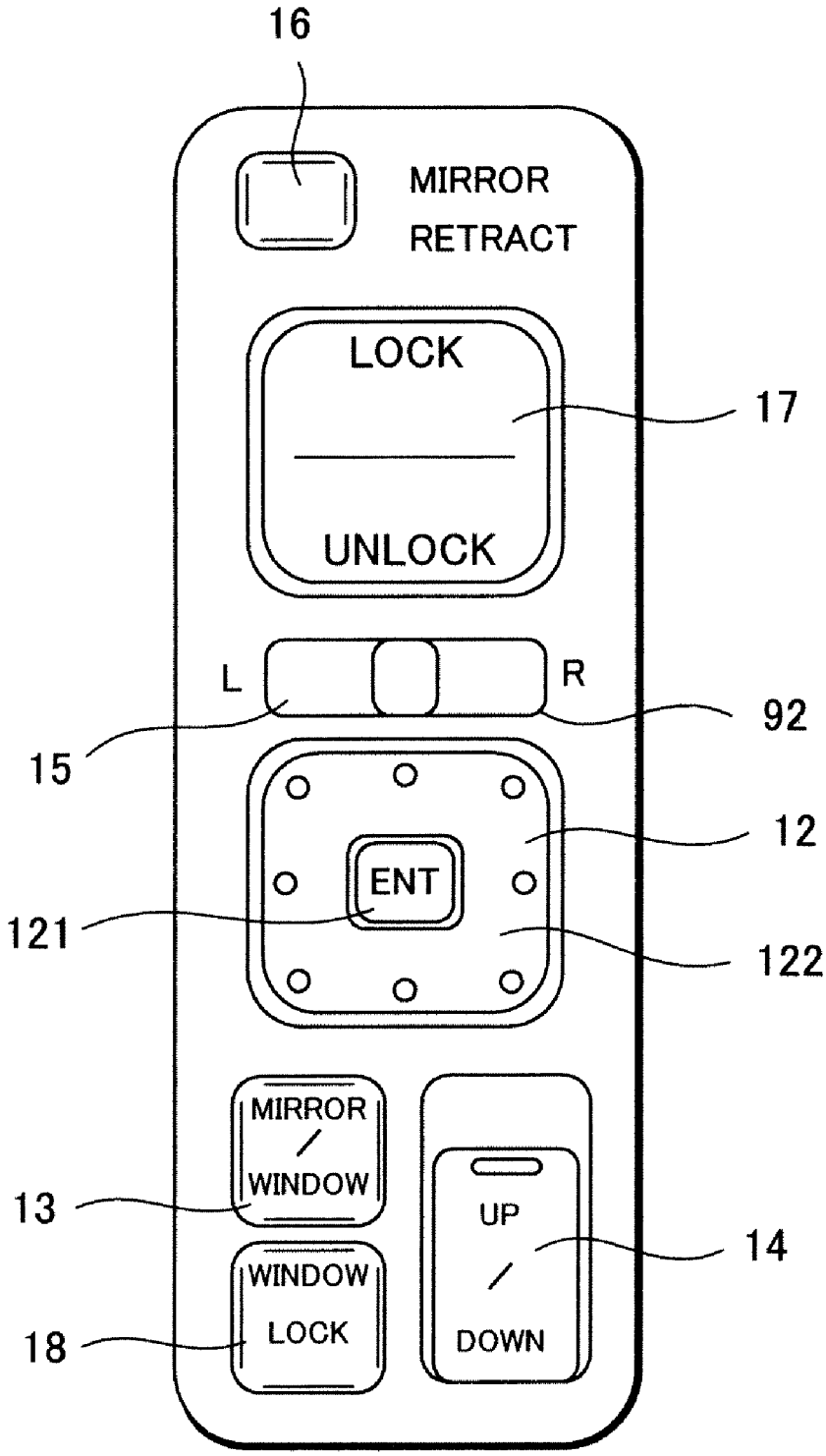
FIG. 3 PRIOR ART
FIG. 3 is a front view of a switch panel of a conventional switch control device for use in a vehicle.

FIG. 2 illustrates an exemplary configuration of the control system of the switch control device for use in a vehicle according to the present invention.

In the shown control system, the electronic control unit (ECU) 2 reads the states of the multifunction switch SW1, the window opening/closing switch SW2 and the side mirror selecting switch SW3 and gives a command for opening or closing a specified power window to the motor driving circuit 3 for driving motors M11, M12, M13 and M14 into normal or reverse rotation. The electronic control unit (ECU) 2 also gives a command for adjusting the viewing angle of right side mirror to the motor driving circuit 3 for driving motors M21 and M22 into normal or reverse directions for adjusting the viewing angle of the right side mirror in vertical and horizontal directions as well as a command for adjusting the viewing angle of left side mirror to the motor driving circuit 3 for driving motors M23 and M24 into normal or reverse directions for adjusting the viewing angle of the right side mirror in vertical and horizontal directions.

The multifunction switch SW1 is also provided with switch contacts one at each of four corners C1, C2, C3 and C4 corresponding to the driver's seat side window (FR), assistant's seat side window (FL), rear left seat side window (RL) and rear right seat side window (RR) respectively. The window opening/closing switch SW2 has a switch contact UP-AUTO for automatically closing windows to a full extent, contact UP for arbitrarily closing windows, contact DOWN for arbitrarily opening windows and contact AUTO-DOWN for automatically opening windows to a full extent. The mirror selecting switch SW3 has a contact R for selecting right side mirror and a contact L for selecting a left side mirror.

While opening or closing each of the windows, the electronic control unit (ECU)2 can determine the current position of each of windows by counting the number of pulses from each of pulse generators P1, P2, P3 and P4 working in synchronism with rotations of the driving motors M23 and M24 respectively. When the window was completely closed or opened and no pulse was further received, the electronic control unit turns off the corresponding driving motor.

In the motor driving circuit 3, each of driving lines for opening/closing the power windows and each of driving lines for adjusting the viewing angle of the side mirrors are provided with relays (not shown) for turning on and off the battery power for each motor with polarity of rotating in normal direction and relays (not shown) for turning on and off the battery power for each motor with polarity of rotating in reverse direction. ON-OFF operations of these relays are carried out under the control of the electronic control unit ECU2.

Functions of the multifunction switch SW1 are as follows:

(1) Changing the Control Mode from "Power Windows" Control Mode to "Power Side Mirrors" Control Mode and Vice Versa In case if the multifunction switch SW1 was not operated for more than a specified duration t1 (for example, 10 seconds), the control mode is automatically changed to "power window" control mode under control of the electronic control unit ECU2. The control mode is further changed from "power window control mode" to "power side mirror control mode" when the switch SW3 was operated to select the right or left side mirror.

If the multifunction switch in the "power side mirror" control mode was operated for more than a specified period of time t1, then the control mode automatically returns to the "power window" control mode in which the power windows are ready to be opened or closed.

(2) Selection of all Windows in the "Power Window" Control Mode

When the whole operating surface of the multifunction switch SW1 was pushed down for more than a specified period of time t2 (for example, 3 seconds) with at least three of four corner switch contacts C1 to C4 (see FIG. 2) as turned on at the same time, the electronic control unit ECU2 recognizes the above-mentioned state of the multifunction switch SW1 by reading turned-on contact signals from three of four corner contacts C1 to C4 (see FIG. 2) of the switch, in which all windows including a driver's seat side window, assistant's seat side window, rear left side window and rear right side window are selected. In this state, all windows can be operated by using the window opening/closing switch SW2 under control of the electronic control unit ECU2.

The reason why the turning-on of at least three (not four) corner contacts is set for the condition of selecting all windows is that, if the turning-on of all four corner switch contacts C1 to C4 is set, the switch may fail in turning on all contacts by pushing down the whole surface of the multifunction switch SW1.

(3) Selecting Ventilation Function in the Power Window Control Mode

When the whole operating surface of the multifunction switch SW1 was pushed down for a specified short time t3 (for example, 1 second) with at least three of four corner switch contacts C1 to C4 as turned on at the same time, the electronic control unit ECU2 reads turned-on signals of the three corner switch contacts of the multifunction switch SW1 and recognizes the ventilation function is selected. In this instance, all windows are automatically opened to a specified degree of opening for ventilation under control of the electronic control unit ECU2.

(4) Selection of Each of the Power Windows in the Power Window Control Mode

When the operating surface of the multifunction switch SW1 was tilted by pressing in one direction, turning on one of the corner contacts C1 to C4 which correspond to the driver's seat side window, assistant's seat side window, rear left side window and rear right side window, the electronic control unit ECU2 reads a signal of the turned-on switch contact and recognizes the selected window. In this state, the selected window can be operated by using the window opening/closing switch SW2 under control of the electronic control unit ECU2

(5) Adjustment of Viewing Angle of Side Mirrors in the Power Side Mirror Control Mode When the operating surface of the multifunction switch SW1 in the power side mirror control mode was tilted by pressing in one direction with, for example, two right switch contacts C1 and C4 turned on, the right (R) or left (L) side mirror selected by the mirror selector switch SW3 is tilted in the right direction under control of the electronic control unit ECU2 until the switch contacts C1 and C4 are turned off. Similarly, the selected side mirror is tilted upward while two upper switch contacts C1 and C2 are turned on, the selected side mirror is tilted leftward while two left switch contacts C2 and C3 are turned on and the selected side mirror is tilted downward while two lower switch contacts C3 and C4 are turned on. The switch control device for use in a vehicle according to the present invention comprises a switch panel on which a multifunction switch, a window opening/closing switch and a side mirror selector switch for selecting a left or right side mirror are simply arranged, can effectively perform all operations necessary for changing control mode, selecting all windows, ventilation and adjusting the viewing angle of side mirrors with no need of providing additional switches and can also perform effective control of driving motors of each of the power windows and each of the power side mirrors. Thus, the switch control device according to the present invention is featured by simplicity of operation switches and improved operability, thereby offering the great advantage on its application.

What is claimed is:

1. A switch control device for use in vehicle, the control device has a control unit for reading an operation state of each of switches for opening/closing each of windows of the vehicle and an operating state of each of switches for tilting each of side mirrors of the vehicle and controlling each of drives for opening/closing windows and each of drives for tilting the side mirrors in accordance with the read operation state of each of the switches, wherein the switch control device comprises a switch panel provided with a multifunction switch having a square operating surface to be pushed down as a whole and tilted toward one of multiple directions for turning ON and OFF each of switch contacts disposed one at each of four corners, a window opening/closing switch and a power side mirror selecting switch for selecting one of left and right side mirrors, wherein, when the multifunction switch is not operated for more than a specified period of time, a control mode is automatically changed to a window opening/closing control mode and the control mode is turned from the window opening/closing control mode to a side mirror drive control mode by operating the power side mirror selecting switch.

2. The switch control device for use in a vehicle according to claim 1, wherein the control unit in the window opening/closing control mode measures the operation period of the multifunction switch whose operating surface is pushed down with at least three of the corner switch contacts as turned on at the same time and, when the measured time exceeds a specified period of time, all windows are selected to be operated by using the window opening/closing switch.

3. The switch control device for a vehicle according to claim 1, wherein the switch control device in the window opening/closing control mode measures the operation period of the multifunction switch whose operating surface is pushed down with at least three of the four corner switch contacts as turned on at the same time and, when the measured time is not more than a specified period of time, all power windows are selected and automatically opened or closed to a specified degree of opening.

4. The switch control device for a vehicle according to claim 1, wherein, when the operating surface of the multifunction switch in the window opening/closing control mode is tilted toward one of the multiple directions and one of the four corner switch contacts corresponding to one of windows of the vehicle is turned on, the corresponding window is selected and further opened or closed by using the window opening/closing switch.

5. The switch control device for a vehicle according to claim 1, wherein, when the operating surface of the multifunction switch in the side mirror drive control mode is tilted upward, downward, rightward or leftward and two corner switch contacts are turned on, a selected power side mirror is tilted toward the tilted direction while the contacts are kept in the turned-on state.

* * * * *